US006558473B2

(12) United States Patent
Okazawa et al.

(10) Patent No.: US 6,558,473 B2
(45) Date of Patent: May 6, 2003

(54) DRY ICE CLEANING METHOD, DRY ICE CLEANING APPARATUS, AND PART OR UNIT CLEANED BY DRY ICE

(75) Inventors: Masaki Okazawa, Kanagawa (JP); Hideo Iwama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 09/995,746

(22) Filed: Nov. 29, 2001

(65) Prior Publication Data

US 2002/0068511 A1 Jun. 6, 2002

(30) Foreign Application Priority Data

Dec. 5, 2000 (JP) ..... 2000-369867

(51) Int. Cl.[7] ..... B08B 7/04

(52) U.S. Cl. ..... 134/6; 134/2; 134/7; 134/18; 134/34; 134/36; 134/42; 134/902; 451/38; 451/39; 451/75; 451/102

(58) Field of Search ..... 134/2, 6, 7, 18, 134/34, 36, 42, 902; 451/38, 39, 75, 102

(56) References Cited

U.S. PATENT DOCUMENTS

| | | | | | |
|---|---|---|---|---|---|
| 2,699,403 | A | * | 1/1955 | Courts | 117/47 |
| 4,038,786 | A | | 8/1977 | Fong | 51/320 |
| 4,655,847 | A | * | 4/1987 | Ichinoseki et al. | 134/7 |
| 5,228,894 | A | | 7/1993 | Sato et al. | 65/102 |
| 5,593,339 | A | * | 1/1997 | Yam et al. | 451/36 |
| 5,612,302 | A | * | 3/1997 | Yoshida et al. | 510/174 |
| 5,967,156 | A | * | 10/1999 | Rose et al. | 134/7 |

FOREIGN PATENT DOCUMENTS

| | | | |
|---|---|---|---|
| JP | 51-60095 | | 5/1976 |
| JP | 61-15749 | | 1/1986 |
| JP | 61-015749 | * | 1/1986 |
| JP | 06-053199 | * | 2/1994 |
| JP | 409011131 A | * | 1/1997 |
| JP | 10-202208 | * | 8/1998 |
| JP | 10-202210 | * | 8/1998 |
| JP | 10-319634 | * | 12/1998 |
| JP | 10-319638 | * | 12/1998 |
| JP | 02000167502 A | * | 6/2000 |

* cited by examiner

*Primary Examiner*—Sharidan Carrillo
(74) *Attorney, Agent, or Firm*—Fitzpatrick, Cella, Harper & Scinto

(57) ABSTRACT

A method of cleaning a component or a unit of an image forming apparatus which has been contaminated by a toner used for image forming includes the steps of blasting a target surface of the component or unit which has been contaminated by the toner with dry ice, and supplying a detergent to the target surface when the target surface is blasted with dry ice. In addition, a type or concentration of the detergent is adjusted in accordance with a type of the toner used for image forming.

1 Claim, 4 Drawing Sheets

DRY ICE CLEANING METHOD, DRY ICE CLEANING APPARATUS, AND PART OR UNIT CLEANED BY DRY ICE

FIELD OF THE INVENTION

The present invention relates to a method of cleaning a cleaning target and, more particularly, a technique for removing soil or contamination of a surface to be cleaned of a cleaning target by blasting it with a granular dry ice fluid.

The present invention also relates to a method of cleaning components or units including electric components of a business machine, electric device, and the like by blasting it with dry ice and a detergent.

In addition, the present invention relates to a dry ice cleaning apparatus for blasting a cleaning target with dry ice.

Further, the present invention relates to a technique which removes soil and an attaching substance from components or units of a business machine, electric device, and the like, and allows to recycle the cleaned components.

BACKGROUND OF THE INVENTION

A technique for causing dry ice particles as a cleaning agent to impinge on a surface to be cleaned, thereby removing a substance attaching to the surface be cleaned is disclosed in, e.g., Japanese Patent Laid-Open No. 61-15749.

Japanese Patent Laid-Open No. 10-202210 discloses a cleaning system for automatically carrying out the cleaning operation of a recycling component while preventing it from being damaged.

The technique shown in this reference discloses a system for removing soil of a recycling component of an office automation apparatus by blasting it with granular dry ice. This technique has a cleaning nozzle which injects granular dry ice together with pressurized air, and a system which carries out the cleaning operation while moving the cleaning nozzle along the surface of the recycling component.

Japanese Patent Laid-Open No. 10-202208 discloses a system which performs a cleaning operation by using dry ice pellets as a medium.

Japanese Patent Laid-Open No. 51-60095 discloses a technique with a sand blast method using a sublimation material.

Japanese Patent Laid-Open No. 06-53199 discloses a technique for cleaning a surface to be cleaned with dry ice, and Japanese Patent Laid-Open No. 09-11131 discloses a technique in which cleaning is performed by using dry ice particles and a surfactant.

A need for reusing or so-called recycling the constituent components and units of a business machine and electrical appliance has become strong in terms of effective utilization of resources, countermeasure for environmental pollution, and the like.

To recycle the constituent components and units of the above machine and device, they must be removed from the machine and device, and whether they function correctly must be checked. Also, these components and units must be maintained in or restored to an almost brand-new state.

In practice, such machine and device have been soiled or contaminated in the atmosphere where they have been used, and a cleaning operation is needed to remove their soil and contamination.

For example, regarding a copying machine or printer as an example of a business machine, as it uses toner as the image forming material, soil or contamination due to toner dust occurs in, e.g., the fixing unit and components and units around it.

Regarding electric home appliances such as a television, air conditioner, refrigerator, cooler, and the like, regulations for recycling have been put into operation. A recycling system is also needed for the components of other electrical and electronic devices, business machines, data communication devices, and industrial machines in terms of the environmental and resource problems.

To recycle the components and units incorporated in these machines and devices, countermeasures such as cleaning methods and apparatuses are required for each specific atmosphere where such machine and device is used and for each contamination source.

For recycling and restoring machines and devices, a cost required for business entities to supply the recycled machines and devices on the market again needs to be reduced.

SUMMARY OF THE INVENTION

The present invention has been made in view of the problems described above, and has as its object to clean a machine and device soiled in accordance with an atmosphere, where it has been used, to make it be suitable for recycle.

In order to solve the above problems, according to the present invention, there is provided a method of cleaning a cleaning target such as a component or unit including an electrical component while blasting the component or unit with dry ice, wherein in blasting the cleaning target with the dry ice, a detergent is dropped or sprayed toward the cleaning target, and cleaning is performed while the dry ice and the detergent simultaneously act on a surface to be cleaned of the cleaning target.

Furthermore, cleaning is performed while a type and concentration of the detergent are adjusted in accordance with a type of contaminant of the cleaning target.

Furthermore, cleaning is performed while a concentration and amount of the detergent are adjusted in accordance with a contamination degree of the cleaning target.

Furthermore, cleaning is performed while an amount and size of the dry ice are adjusted in accordance with a type of contaminant and a contamination degree of the cleaning target.

As an aspect of the present invention, there is provided an apparatus for cleaning a cleaning target such as a component or unit including an electrical component while blasting the component or unit with dry ice, comprising means for blasting the cleaning target with the dry ice, storage means for storing a detergent, and means for making the dry ice and the detergent simultaneously act on the surface to be cleaned while the detergent stored in the storage means is dropped or sprayed toward the surface to be cleaned of the cleaning target, thereby solving the above problems.

Furthermore, the apparatus further comprises means for adjusting a concentration or amount of the detergent.

Furthermore, the apparatus further comprises means for discriminating a type of contaminant of the cleaning target.

According to another aspect of the present invention, there is provided a component or unit including an electrical component, wherein in blasting the component or unit with dry ice, a detergent is dropped or sprayed toward a cleaning target, and cleaning is performed while the dry ice and the detergent simultaneously act on the component or unit.

Furthermore, cleaning is performed while a type and concentration of the detergent are adjusted in accordance with a type of contaminant of the component or unit.

Furthermore, cleaning is performed while a concentration and amount of the detergent are adjusted in accordance with a contamination degree of the component or unit.

Furthermore, cleaning is performed while an amount and size of the dry ice are adjusted in accordance with a type of contaminant and a contamination degree of the component or unit.

Other objects and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

[First Embodiment]

The embodiments of the present invention will be described with reference to the accompanying drawings.

Figure 1:
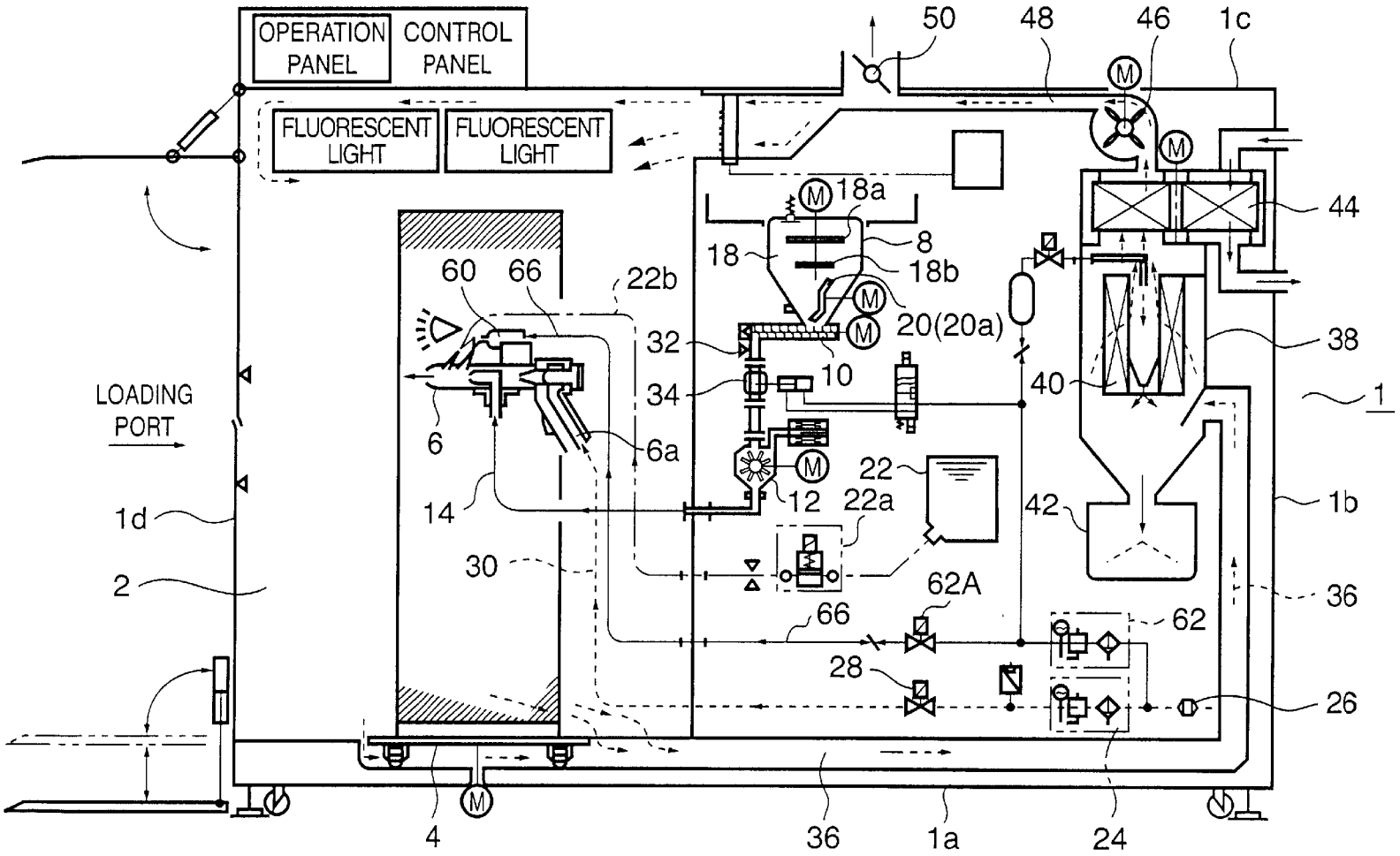
FIG. 1 is a view for explaining the arrangement of a cleaning apparatus according to the present invention.

FIG. 1 is a view showing the arrangement of the main part of a dry ice cleaning apparatus that practices the present invention. Referring to FIG. 1, reference numeral 1 denotes the housing of the apparatus body. The housing 1 is constituted by a base 1*a,* outer wall 1*b,* ceiling 1*c,* opening 1*d,* and the like.

Reference numeral 2 denotes a cleaning booth set in the housing 1. A rotary table 4 is set in the cleaning booth 2, and a cleaning target is placed on the rotary table 4.

Reference numeral 6 denotes a blast nozzle arranged in the cleaning booth 2 to blast dry ice.

The blast nozzle 6 is hung from the ceiling of the cleaning booth 2 by a cord (not shown).

Reference numeral 8 denotes a hopper 8 for storing dry ice. A device 10 for supplying a predetermined amount of dry ice is arranged at the lower opening of the hopper 8.

The supply device 10 is constituted by a spiral gear rotatably driven by a motor, a cylinder for rotatably storing the spiral gear, and the like.

Reference numeral 12 denotes a dry ice crushing device connected to the dry ice supply device 10. The dry ice crushing device 12 is constituted by a crushing rotary blade, rotary motor, and the like.

The crushing device 12 is connected to the dry ice supply port of the dry ice blast nozzle 6 through a connection pipe 14.

One part of the connection pipe 14 which extends from the crushing device 12 to the cleaning booth 2 is formed from a stainless pipe, and the other part which extends to the blast nozzle 6 in the cleaning booth 2 is formed from a flexible connection pipe.

Reference numeral 18 denotes a first agitation device. The first agitation device 18 is constituted by first propellers 18*a* and 18*b* mounted on a shaft parallel to the direction of gravity in a hopper cylinder, and a motor 18C for rotatably driving the propellers 18*a* and 18*b*.

Reference numeral 20 denotes a second agitation device. The second agitation device 20 is constituted by a second propeller 20*a* rotatable in a direction parallel to a direction perpendicular to the direction of gravity, and a motor for rotatably driving the second propeller 20*a*.

The agitation devices 18 and 20 prevent dry ice in the hopper from bridging, and the second propeller 20*a* may have a tilt angle.

Reference numeral 22 denotes a container for storing a detergent as the detergent. The container 22 is connected to the blast port of the dry ice blast nozzle 6 through a flow rate regulation pump 22*a* and supply pipe 22*b*.

Reference numeral 24 denotes a blast air adjustment device. The blast air adjustment device 24 adjusts pressurized air supplied from an air supply pipe 26 to a predetermined pressure and supplies it to an air supply port 6*a* of the blast nozzle through a valve 28 and pipe 30.

Reference numeral 32 denotes a sensor that forms a supply amount detection device for detecting the amount of dry ice supplied from the dry ice supply device 10. The sensor 32 is formed on a supply pipe connected to the supply device 10.

Reference numeral 34 denotes a regulating valve for constituting a supply amount regulation device.

Reference numeral 36 denotes a recovery pipe for recovering dry ice containing the detergent that has cleaned the cleaning target. The recovery pipe 36 is connected to a dust collection device 38.

Reference numeral 40 denotes a dust collection filter arranged in the dust collection device 38; 42, a dust tank; and 44, a recovery device for recovering carbon dioxide ($CO_2$) of dry ice.

Reference numeral 46 denotes an exhaust blower; 48, an exhaust pipe; and 50, an exhaust regulation damper.

[Explanation of Cleaning Target]

Figure 2:
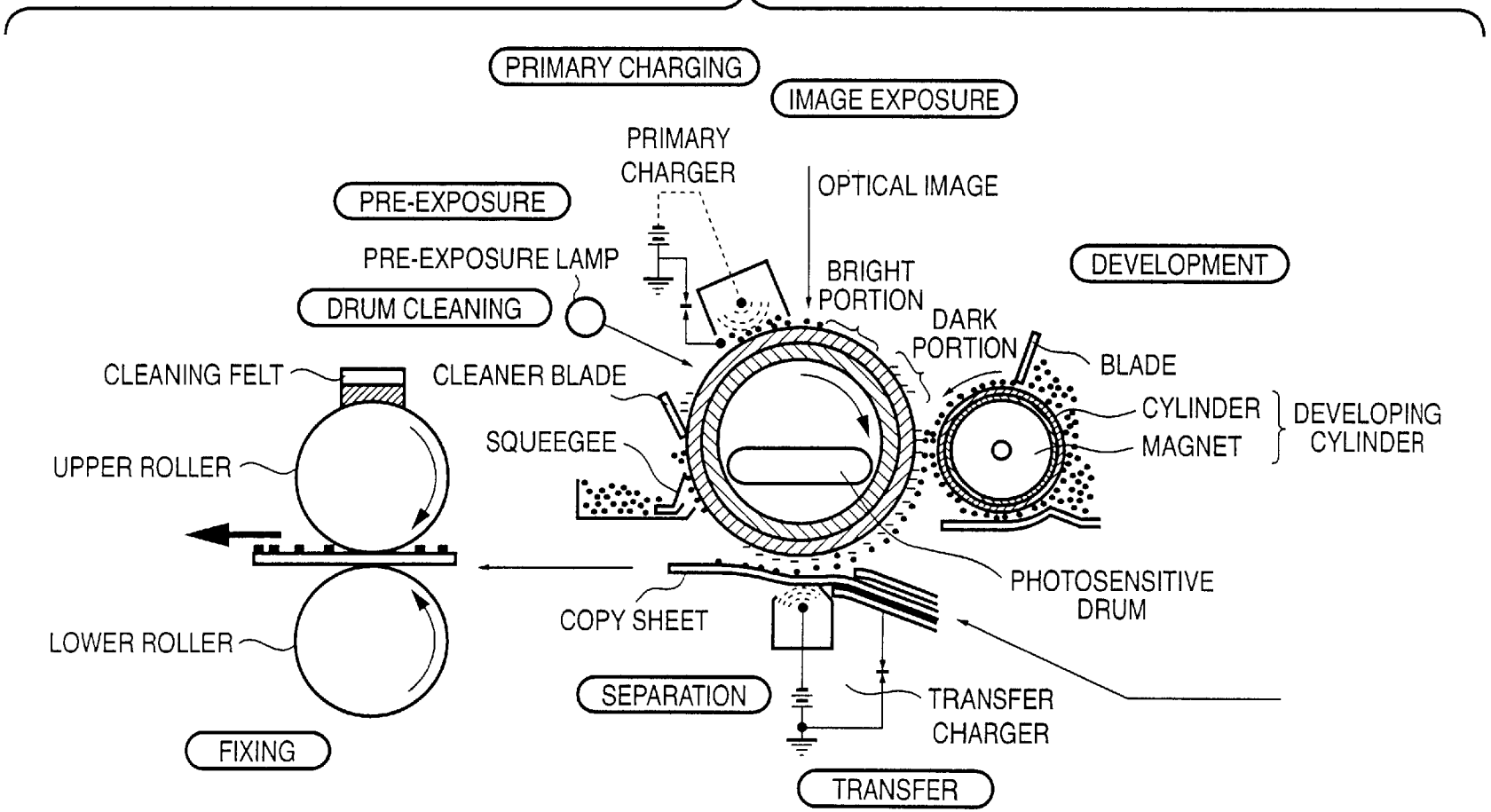
FIG. 2 is a view for explaining a cleaning target to which the present invention is applied.

FIG. 2 is a view for explaining the main part of a copying machine which is to be cleaned with the cleaning apparatus according to the present invention. The copying machine prints information such as an image or character on an image carrier such as a sheet by fixing toner as an image forming material onto it.

As shown in FIG. 2, the copying machine forms a latent image to be printed on a photosensitive drum, and transfers the latent image onto the sheet with the toner, thus forming an image.

The units of the copying machine shown in FIG. 2 are divided so they are suitable for assembly operation or overhaul operation.

When the copying machine is set in an atmosphere where it is to be used and copying operation is performed, the units of the respective portions in the copying machine are soiled to produce contamination in accordance with the frequency they have been used and the atmosphere where they have been used.

The soil or contamination is caused by various factors, e.g., soil caused by the toner scattered by a toner mechanism portion incorporated in the copying machine to reach respective portions such as a developing unit, image exposure unit, transfer unit, and drum cleaning unit, soil caused by the toner when repairing the respective portions, ambient dust attracted and attached by the static electricity of the electrical circuit units of the respective portions, and paper dust of a sheet serving as an image carrier.

Figure 3:
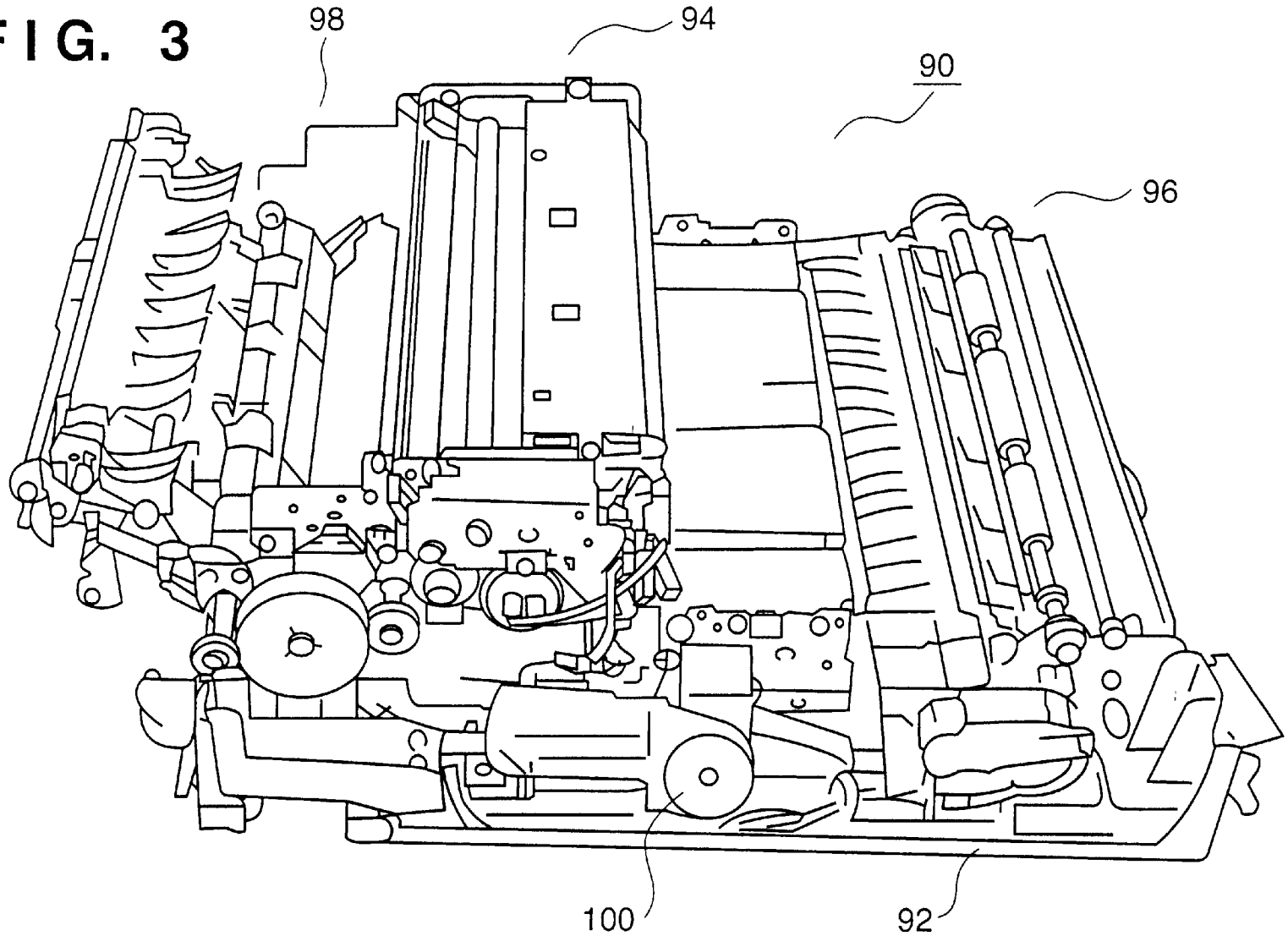
FIG. 3 is a view for explaining the arrangement of a fixing unit in a copying machine.

FIG. 3 is a perspective view of the main part of a fixing unit in the copying machine.

Referring to FIG. 3, a fixing unit 90 is formed by incorporating a fixing device 94, paper feed device 96, delivery device 98, and any other driving system 100 in a unit housing 92. During a fixing process, toner from a toner cartridge serves as the contaminating source of the respective portions.

[Description of Operation]

The operation of this apparatus will be described next.

A unit of the copying machine shown in FIG. 2, e.g., a transfer unit is removed from the copying machine body. A unit cover (not shown) is removed from the transfer unit to set it in a state wherein the cleaning operation can be done, and this unit is then placed on the rotary table 4 in FIG. 1.

The dry ice supply device 10 supplies dry ice pellets in the hopper 8.

While filling the hopper 8 with the predetermined amount of dry ice pellets, the first and second agitation devices 18 and 20 start rotational operation.

In this embodiment, the dry ice pellets have a size of 3 mm.

The amount of dry ice pellets to be supplied to the hopper is 30 liters.

The rotational speed of the propellers of the first agitation device 18 was set to 5 rpm, and the rotational speed of the propeller of the second agitation device 20 was set to 9 rpm.

With the above conditions, the size of the dry ice pellets at the outlet of the hopper could be set to 3 mm to 10 mm.

The size of the dry ice pellets to be supplied to the crushing device 12 through the dry ice supply device 10 allowed that the dry ice pellets could be prevented from sticking to each other in the hopper 8 because of the agitating operations of the first and second first agitation devices. Also, the dry ice pellets to be supplied to the blast port of the blast nozzle 6 through the supply pipe 14 could be held to the predetermined size described above.

The dry ice pellets formed by crushing with the dry ice crushing device 12 are supplied to the blast nozzle 6 through the supply pipe 14.

Pressurized air is supplied to the blast nozzle 6 from the pressurized air supply device 24 through the valve 28.

The detergent is supplied from the detergent supply device 22 through the pump 22*a*.

As the detergent of this embodiment, a weak alkali detergent for a machine and device is used.

The amount of dry ice per unit area of the surface to be cleaned of the cleaning target was set to 0.80 g/cm$^2$ to 0.12 g/cm$^2$ per min, and the dropping amount of detergent was set to 0.15 g/sec to 0.30 g/sec.

The surface to be cleaning of a unit of the copying machine as the cleaning target placed on the cleaning booth 2 is subjected to blast operation with the blast nozzle. When the surface to be cleaned is blasted with a mixture of pressurize air, dry ice pellets, and detergent, the soil and contamination of the surface to be cleaned can be removed.

[Second Embodiment]

The second embodiment proposes a dry ice cleaning apparatus for the degree of contamination.

In the first embodiment, a cleaning target is the fixing unit in the copying machine, and a soil or contamination target is the image forming toner. If a cleaning target is another unit, and soil or contamination is caused by an object except for toner, e.g., oil or a composite contaminant of machine and device in an atmosphere where it has been used, countermeasures for cleaning are required for these target and contaminant.

This embodiment proposes a cleaning method and apparatus which can be applied even in a case wherein soil or contaminant is different from toner.

Figure 4:
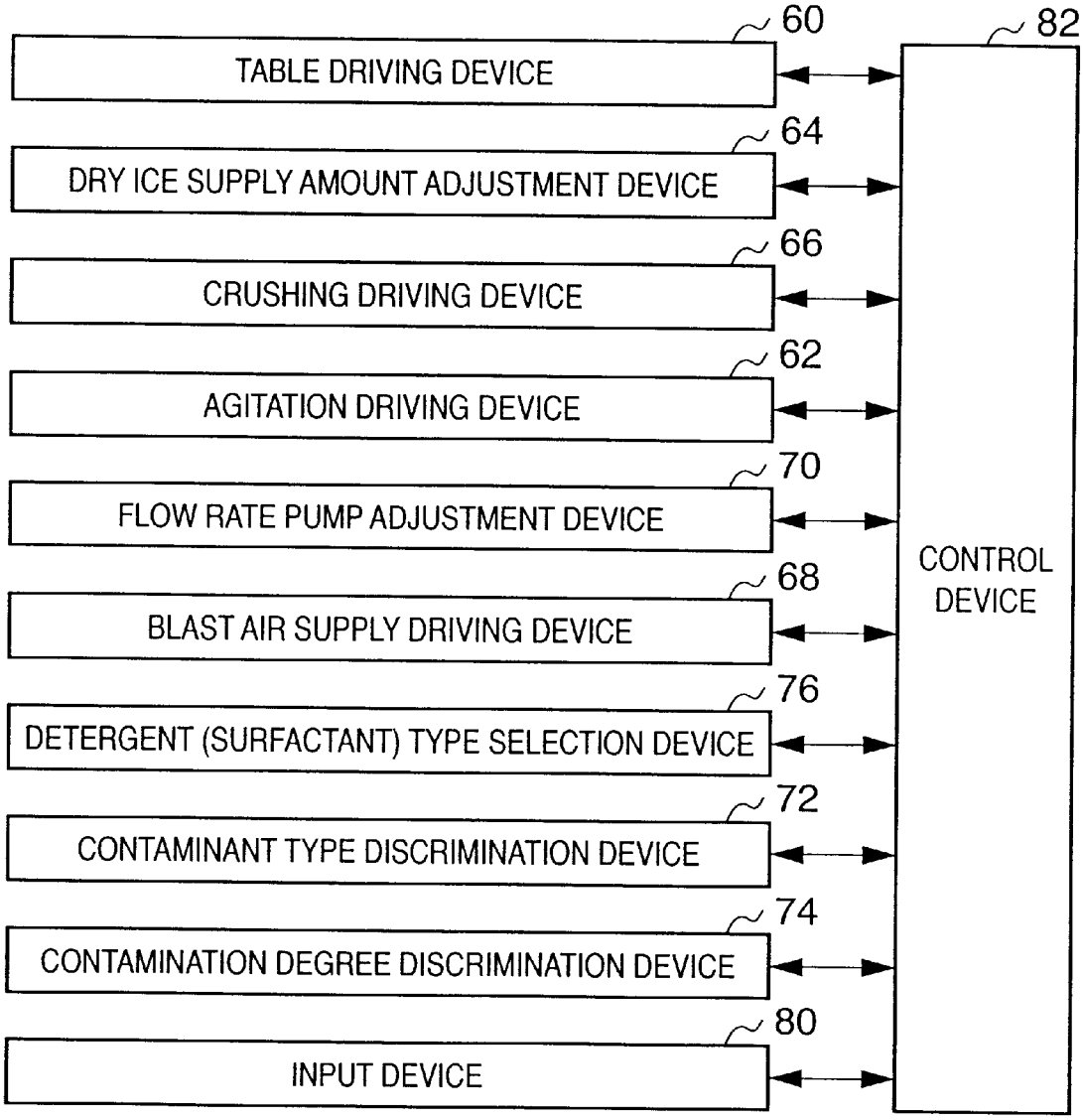
FIG. 4 is a control block diagram.

FIG. 4 is a block diagram showing the control device of a cleaning apparatus in this embodiment.

Reference numeral 60 denotes a table driving device for the rotary table; 62, an agitation driving device for the agitation device of the hopper; 64, a dry ice supply amount adjustment device for the supply device; 66, a crushing driving device for the crushing device; 68, a blast air supply driving device for the pressurizing device; and 70, a flow rate pump adjustment device for adjusting a detergent supply amount.

Reference numeral 72 denotes a contaminant type discrimination device for discriminating contaminant of a cleaning target. In this embodiment, an operator designates an identification number depending on cleaning targets.

Reference numeral 74 denotes a contamination degree discrimination device for discriminating the degree of soil or contamination. The contamination degree discrimination device 74 compares a signal from a sensor which detects a surface to be cleaned of a cleaning target with a signal from a device for storing a predetermined clean state (a state before shipped as a product) of the surface to be cleaned of the cleaning target to obtain numerical information of the degree of soil of the cleaning target, and outputs the numerical information.

Reference numeral 76 denotes a detergent type selection device for selecting the type of detergent on the basis of the information from the contamination degree discrimination device 74.

Reference numeral 78 denotes a detergent blast amount discrimination device for adjusting the blast amount of detergent on the basis of the information from the contamination degree discrimination device 74.

Reference numeral 80 denotes an input device.

Reference numeral 82 denotes a control device for controlling the respective devices.

The cleaning apparatus in this embodiment can employ the same arrangement as in FIG. 1.

In this embodiment, a detergent supply device 22 is formed from a plurality of liquid tanks in which a plurality of detergents are stored, and the regulation valves of the respective tanks are connected to the detergent type selection device 76.

The degree of soil and the type of contaminant of the cleaning target are discriminated, and the contamination degree discrimination device 74 and the contaminant type discrimination device 72 output the pieces of identification information in accordance with the degree of soil and contaminant, respectively.

For example, type numbers 1, 2, 3, and 4 are defined in accordance with the degrees of cleaning difficulty of a surface to be cleaned and the type of contaminant.

The detergent type selection device 76 selects a detergent corresponding to soil of the surface to be cleaned in accordance with the identification signals output from the contamination degree discrimination device 74 and contaminant type discrimination device 72.

As described above, according to the above embodiments, there is provided a method of cleaning a cleaning target such as a component or unit including an electrical component while blasting it with dry ice, wherein in blasting the cleaning target with the dry ice, a detergent is dropped or sprayed toward the cleaning target, and cleaning is performed while the dry ice and the detergent simultaneously act on a surface to be cleaned of the cleaning target. This allows to perform efficient cleaning operation of the surface to be cleaned.

Furthermore, since cleaning is performed while a type and concentration of the detergent are adjusted in accordance with a type of contaminant of the cleaning target, the present invention can cope with various types of cleaning targets.

Furthermore, cleaning is performed while a concentration and amount of the detergent are adjusted in accordance with a contamination degree of the cleaning target, thereby increasing a cleaning performance for each type of contaminant.

As an aspect of the present invention, there is provided an apparatus for cleaning a cleaning target such as a component or unit including an electrical component while blasting it with dry ice, comprising means for blasting the cleaning target with the dry ice, storage means for storing a detergent, and means for making the dry ice and the detergent simultaneously act on the surface to be cleaned while the detergent stored in the storage means is dropped or sprayed toward the surface to be cleaned of the cleaning target, thereby solving the above problems.

Furthermore, there is provided the dry ice cleaning apparatus having means for adjusting a concentration or amount of the detergent, thereby obtaining a cleaning apparatus with excellent cleaning performance.

In addition, the aspect of the dry ice cleaning apparatus having means for discriminating a type of contaminant of the cleaning target results in a cleaning apparatus with a better countermeasure for environmental pollution.

According to another aspect of the present invention, in a component or unit including an electrical component, in blasting the component or unit with dry ice, a detergent is dropped or sprayed toward a cleaning target, and cleaning is performed while the dry ice and the detergent simultaneously act on the component or unit. Therefore, a component or unit including an electrical component which can cope with recycle can be obtained.

Further, a detergent is dropped or blasted while spraying the surface to be cleaned with dry ice, thereby shortening a cleaning time.

The present invention is not limited to the above embodiments and various changes and modifications can be made within the spirit and scope of the present invention. Therefore, to apprise the public of the scope of the present invention the following claims are made.

What is claimed is:

1. A method of cleaning a component or a unit of an image forming apparatus which has been contaminated by a toner used for image forming, said method comprising the steps of:

blasting a target surface of the component or unit which has been contaminated by the toner with dry ice;

contacting the target surface with a detergent while the target surface is being blasted with the dry ice, wherein said blasting and contacting steps remove the toner from the component or the unit of the image forming apparatus; and adjusting a concentration of the detergent in accordance with the degree of toner contamination present on the component or the unit of the image forming apparatus.

* * * * *

UNITED STATES PATENT AND TRADEMARK OFFICE

CERTIFICATE OF CORRECTION

PATENT NO. : 6,558,473 B2
DATED : May 6, 2003
INVENTOR(S) : Masaki Okazawa et al.

It is certified that error appears in the above-identified patent and that said Letters Patent is hereby corrected as shown below:

Title page,
Item [*] Notice, should read as follows:
-- Subject to any disclaimer, the term of this patent is extended or adjusted under 35 U.S.C. 154(b) by 72 days. --

Signed and Sealed this

Twenty-seventh Day of January, 2004

JON W. DUDAS
*Acting Director of the United States Patent and Trademark Office*